US005984129A

United States Patent [19]

Pasinski

[11] Patent Number: 5,984,129

[45] Date of Patent: Nov. 16, 1999

[54] MOVABLE PAINT TRAY ASSEMBLY FOR APPLYING A LIQUID TO A ROLLER

[76] Inventor: Tom Pasinski, 6131 N. Leader, Chicago, Ill. 60646

[21] Appl. No.: 08/999,110

[22] Filed: Dec. 29, 1997

[51] Int. Cl.[6] ..... B05C 21/00

[52] U.S. Cl. ..... 220/570; 220/697

[58] Field of Search ..... 220/570, 696, 220/697; 248/349.1, 131

[56] References Cited

U.S. PATENT DOCUMENTS

| | | | |
|---|---|---|---|
| Re. 4,197 | 12/1870 | Darling . | |
| Re. 7,127 | 5/1876 | Darling . | |
| 51,931 | 1/1866 | Darling . | |
| 3,707,242 | 12/1972 | Golden et al. | 220/570 |
| 3,752,494 | 8/1973 | Dunn . | |
| 4,549,714 | 10/1985 | Busch | 248/349.1 |
| 4,659,050 | 4/1987 | Tabayashi . | |
| 4,941,229 | 7/1990 | La Pierre . | |
| 5,046,749 | 9/1991 | Owens . | |
| 5,082,301 | 1/1992 | Schumacher et al. . | |
| 5,123,576 | 6/1992 | Lawrence . | |
| 5,169,022 | 12/1992 | Elliott et al. . | |
| 5,441,329 | 8/1995 | Janisch | 248/349.1 X |
| 5,472,111 | 12/1995 | Renfrew | 220/570 |
| 5,511,279 | 4/1996 | Ippolito | 220/570 X |

*Primary Examiner*—Andres Kashnikow
*Assistant Examiner*—Sean P. O'Hanlon
*Attorney, Agent, or Firm*—Ladas & Parry

[57] ABSTRACT

A paint tray assembly for applying a liquid to a roller wherein the paint tray assembly is adapted to continuously allow the paint tray assembly to be conveniently positioned to apply paint to the roller as a painter moves around a room. The paint tray assembly provides for a top portion rotationally coupled to a bottom portion for allowing the paint tray assembly to be rotationally oriented to properly position the ramped surface, with respect to the painter, for applying the liquid to the roller without having to pick up and reposition the tray. The paint tray assembly further provides for sloped external sides, narrower at the point where the paint tray assembly rests against the support surface, assisting in sliding the paint tray assembly across the floor.

18 Claims, 4 Drawing Sheets

MOVABLE PAINT TRAY ASSEMBLY FOR APPLYING A LIQUID TO A ROLLER

BACKGROUND OF THE INVENTION

1. Field of the Invention

The present invention relates generally to painting equipment and more specifically to a movable paint tray assembly for applying a liquid to a roller.

2. Description of the related art

Heretofore, various paint tray assemblies have been used for applying a liquid, like paint, to a roller. Such paint trays are typically rectangular in shape having a partially ramped rectangular bottom surface. The ramped bottom surface starts at the back wall of the tray, and slopes downward to the bottom of the tray as it extends toward the front of the tray. Sidewalls extend around the rectangular bottom surface forming a reservoir for holding paint, which is deeper near the front of the tray and shallower toward the back.

When using such a paint tray, a painter typically approaches the paint tray from the back of the paint tray and will extend the roller into the paint located in the reservoir. Once the paint is absorbed into the roller, the painter pulls the roller back along the ramped bottom surface causing the paint to spread onto the roller with excess paint draining back into the reservoir.

Due to the shape of the tray and the orientation of the ramped bottom surface, the paint can only be conveniently applied to the roller from one direction. As a painter moves around the room, unless the paint tray is continuously reoriented, the painter is often in a poor position to reapply more paint to the roller. The painter in many instances must walk around to the back of the tray in order to reapply more paint to the roller.

Several examples of previously disclosed analogous and non-analogous paint tray assemblies allowing for the painter to apply paint to the roller from a plurality of positions around a room without having to pick up and reorient the paint tray, or paint tray assemblies providing transport mechanisms for assisting in the movement or reorientation of the paint tray are contained in the following U.S. Patents.

Elliott et al., U.S. Pat. No. 5,169,022, discloses a circular paint tray assembly providing a center circular well for holding paint and a sloping paint spreading surface which extends around the circular well the full circumference of the tray. By extending around the full circumference of the tray, the ramped paint spreading surface allows a painter to apply paint to a roller from any position around the tray, without having to pick up and reorient the paint tray.

Owens, U.S. Pat. No. 5,046,749, discloses a U-shaped paint pail having two steeply sloped surfaces for applying paint to a roller. The two sloped surfaces are positioned opposite one another. The two sloped surfaces allow for two painters to simultaneously apply paint to their roller, or to allow a single painter to apply paint to a roller from one of two positions around the paint pail. The U-Shaped paint pail is further mounted on four casters to allow the paint pail to be rolled from one area to another. In the preferred embodiment, the direction of rotation of two casters is limited so as to restrict the movement of the pail to a straight line, often parallel to a wall.

Schumacher et al., U.S. Pat. No. 5,082,301, discloses a mobile work station or cart with wheels and a handle, for holding a paint tray and other paint supplies. The wheels and the handle serve to facilitate movement of the work station as the painter moves from one work area to another work area.

Dunn, U.S. Pat. No. 3,752,494, discloses a paint cart assembly including a roller frame assembly, which may be used to assist in the movement of the cart assembly into an advantageous position with respect to the surfaces being painted and the position where the painter is working.

SUMMARY OF THE INVENTION

According to the present invention there is provided a movable paint tray assembly for applying liquid, like paint, to a roller. The paint tray assembly comprises a top portion and a bottom portion rotationally coupled together, so as to allow the top portion to rotate with respect to the bottom portion. The bottom portion is adapted for resting upon a support surface like a floor.

The top portion includes a reservoir for holding a liquid, having a floor and a sidewall extending around the floor. Within said reservoir starting at or near a section of the sidewall is a ramped surface, which gradually decreases in height as it extends away from the sidewall down into the reservoir. The ramped surface provides a surface for spreading the paint onto the roller. The ramped surface further allows excess paint to flow back into the reservoir.

The top portion further includes a contact point for applying a force to the top portion of the paint tray assembly for rotating the top portion with respect to the bottom portion, wherein the bottom portion remains rotationally stationary with respect to the support surface. This allows the ramped surface for spreading the paint onto the roller to be conveniently rotated so as to face away from the painter and allow the painter to more easily roll paint onto the roller.

Another feature of the paint tray assembly is external sides which are sloped, so as to be narrower at the base of the paint tray assembly where the paint tray assembly rests on the support surface or floor. Often times the floor upon which the paint tray is resting is covered with drop cloths, which have a tendency to bunch up. The sloped external sides provides a smooth sled like surface upon which the paint tray assembly can glide over uneven surfaces like bunched up drop cloths.

The present invention further features a paint tray assembly having a portion of the sidewall forming a hood like enclosure, which extends up and inward, partially covering the open reservoir. Opposite the hood like structure is a handle for picking up the paint tray assembly. The hood like structure forms a pocket for retaining the liquid in the paint tray assembly as the paint tray assembly is tilted, when lifted by a handle located opposite from the hood.

Other objects, features and advantages of the present application will be apparent from the detailed description and drawings which follow.

DESCRIPTION OF THE PREFERRED EMBODIMENT

Figure 1:
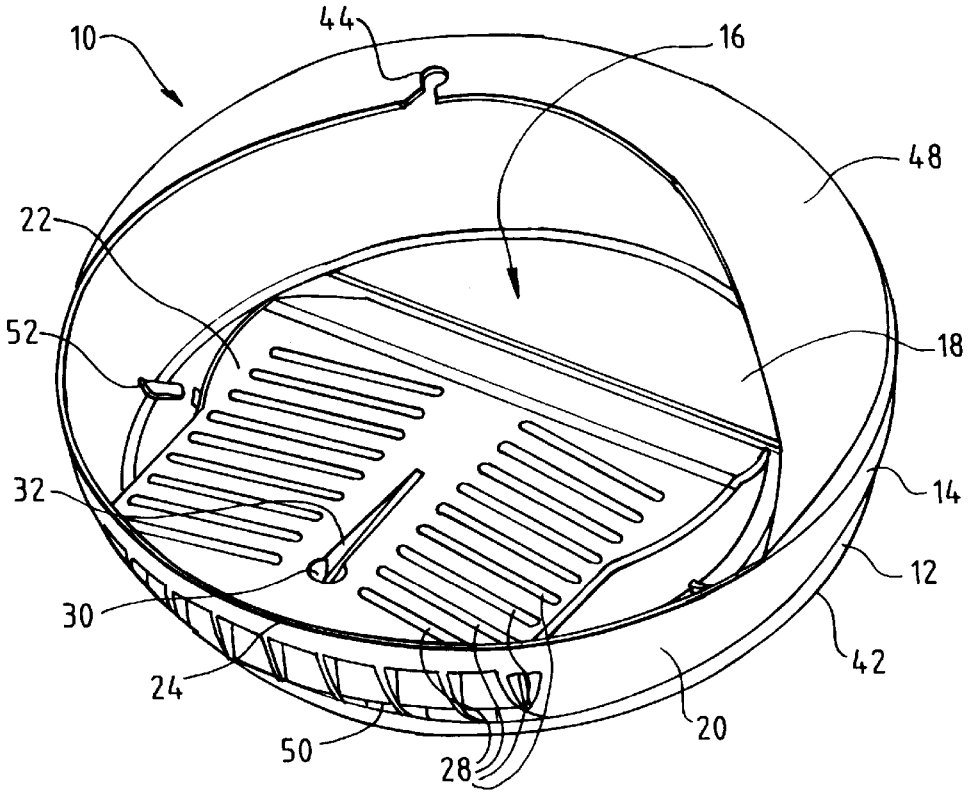
FIG. 1 is a perspective view of a paint tray assembly according to the teachings of the present invention.

Referring now to the drawings in greater detail, there is illustrated in FIG. 1 a perspective view of a paint tray assembly 10 according to the teachings of the present invention. The paint tray assembly 10 includes a bottom potion 12, adapted for resting upon a support surface, like a floor. The paint tray assembly 10 further includes a top portion 14 rotationally coupled to the bottom portion 12, so as to enable the top portion 14 to rotate with respect to the bottom portion 12, while the bottom portion 12 remains stationary with respect to the support surface.

The top portion 14 includes a reservoir 16, having a floor 18 and a sidewall 20 extending around the floor 18. Within the reservoir 16 is a ramped surface 22, which begins at or near a section 24 of the sidewall 20, and gradually decreases in height as the ramped surface 22 extends away from the sidewall 20 into the reservoir 16. Preferably, the ramped surface 22 will decrease in height until it is meets with the floor 18 of the reservoir 16.

Figure 8:
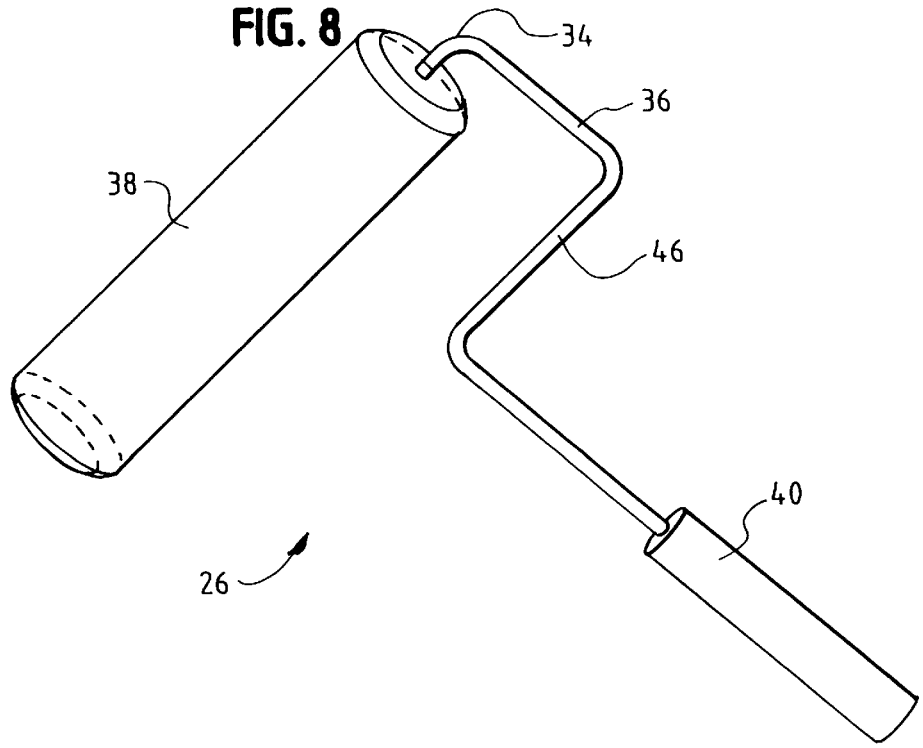
FIG. 8 is a perspective view of a roller used to apply paint to a wall.

The ramped surface 22 provides a surface for rolling the liquid onto a roller. The width of the ramped surface 22 is preferably a little wider than the width of the roller. An example of a roller 26 can be seen in FIG. 8. initially the roller 26 is dipped into the liquid pooled in the reservoir 16. The roller 26 is then rolled back and forth along the ramped surface 22, causing the liquid to spread across the roller 26. Any excess liquid is allowed to flow back into the reservoir 16. The application of the liquid to the roller 26 is most easily accomplished from a position, with respect to the paint tray assembly 10, where the ramped surface 22 is facing directly away from the painter.

In the preferred embodiment the ramped surface 22 further includes a series of spaced apart ribs 28, which assist in spreading the liquid across the roller 26. The ribs 28 are also angled, so as to avoid the formation of places where the excess liquid can become trapped, providing a path for excess liquid to flow back into the reservoir 16.

The top portion 14 further provides a contact point in the preferred form of an indentation 30, which provides a point where a force can be applied so as to rotate the top portion 14 with respect to the bottom portion 12. The indentation 30 preferably includes a slot 32 forming a channel for also allowing excess liquid to flow back into the reservoir 16. The indentation 30, is preferably adapted for receiving a corner 34 of a roller arm 36 of a roller 26, shown in FIG. 8. The roller arm 36 is the portion of the roller 26, connecting a roller sleeve 38 to a handle 40.

By allowing the top portion 14 of the paint tray assembly 10 to rotate, with respect to the bottom portion 12 and the support surface upon which the paint tray assembly 10 is resting, the paint tray assembly 10 can be continuously reoriented to the most convenient position for applying the liquid to the roller 26 as the painter moves around the work area.

The paint tray assembly 10 further provides for an external surface which is sloped, such that the circumference of the paint tray assembly 10 is narrower at the base 42 of the paint tray assembly 10 where the paint tray assembly 10 rests on the support surface or floor.

The sloped external surface provides a sled like base 42, which allows the paint tray assembly 10 to be moved laterally across the support surface or floor. The sloped external surface further assists the paint tray assembly 10 to more easily move up and over small obstacles, like bunched up drop cloths, which are prevalent in work areas where painting is being done.

In order to hook onto the paint tray assembly 10 for pulling it across the work area an engagement point is provided. The engagement point is preferably provided for in the form of a notch 44 in the sidewall 14 of the paint tray assembly 10. The notch 44 is preferably adapted for receiving an edge 46 of the roller arm 36 of the roller 26, shown in FIG. 8.

Opposite the section 24 of the sidewall 20 where the ramped surface 22 starts, the sidewall 20 curves up and back, forming a hood 48. The hood 48 partially covers the reservoir 16 from above. Opposite the hood 48, formed into the sidewall 20 is a handle 50 for picking up the paint tray assembly 10. The handle 50, in the preferred embodiment is in the form of a grill-like structure, molded as part of the sidewall 20.

When the paint tray assembly 10 is tilted and lifted by the handle 50, any liquid located in the reservoir 16 would collect and be retained within the portion of the sidewall 20 forming the hood 48. In this way the paint tray assembly 10 could be picked up and carried like a bucket.

Standard paint trays often require two hands to pick up and balance. This is because standard paint trays typically have shallow paint reservoirs, which as the paint shifts in the reservoir, causes the center of mass to shift a larger distance.

The paint tray assembly 10 of the present application is easily carried with one hand by the handle 50, when the paint tray assembly is tilted with the liquid retained in the hood 48.

Figure 2:
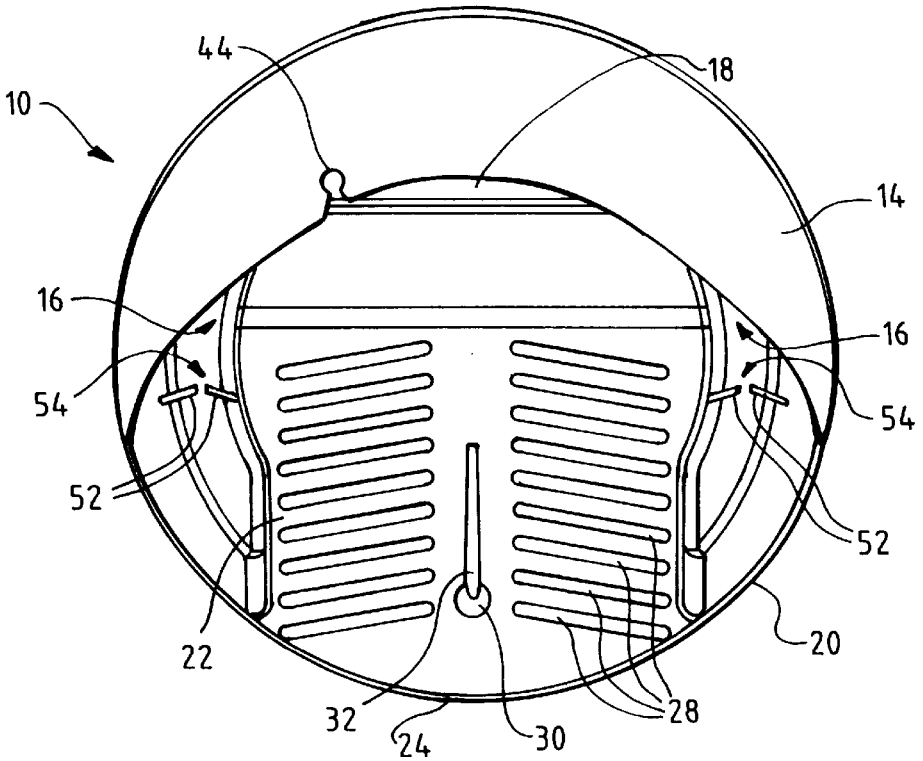
FIG. 2 is a top view of the paint tray assembly, shown in FIG. 1.

Shown in FIG. 2 is a top view of the paint tray assembly 10, shown in FIG. 1. FIG. 2 further illustrates the additional feature of brush retaining walls 52. The brush retaining walls 52 are located between each side of the ramped surface 22 and the sidewall 20, and extend above the floor 18 of the reservoir 16. A paint brush can be retained by being positioned behind the brush retaining walls 52, or the bristles of the brush can straddle the brush retaining wall 52.

Each brush retaining wall 52 contains an opening 54, dividing the brush retaining wall 52 into two sections. Each section of the brush retaining wall 52 is angled in conjunction with the floor 18 of the reservoir 16 to prevent liquid dripping off the brush from being trapped behind the brush retaining wall 52. The floor 18 of the reservoir 16 is only slightly tilted, less than the ramped surface 22, so as to encourage the liquid to collect in the reservoir 16 near the bottom of the ramped surface 22.

Figure 3:
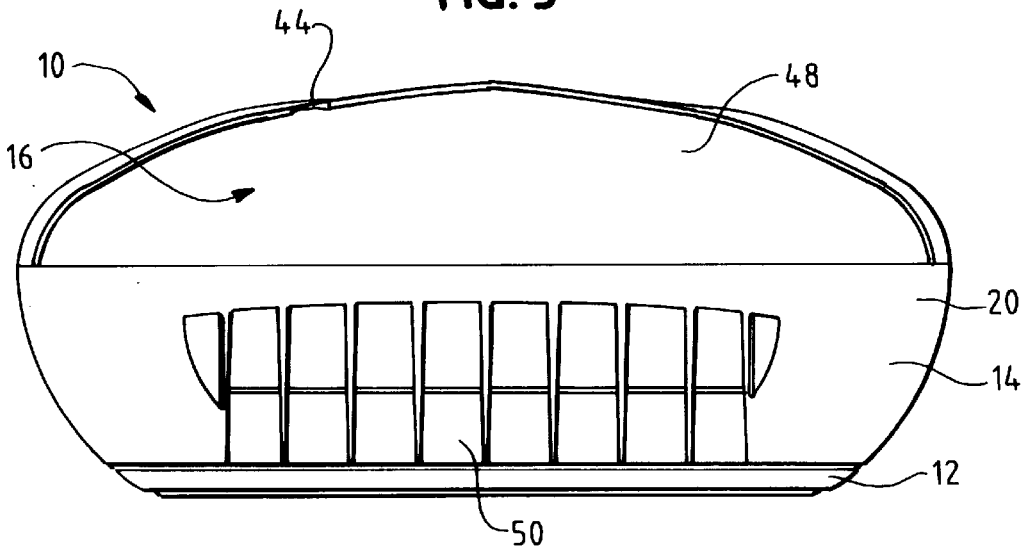
FIG. 3 is a back side view of the paint tray assembly, shown in FIG. 1.

FIG. 3 shows a back side view, which more clearly illustrates the grill-like handle 50 molded into the sidewall 20 of the paint tray assembly 10.

Figure 4:
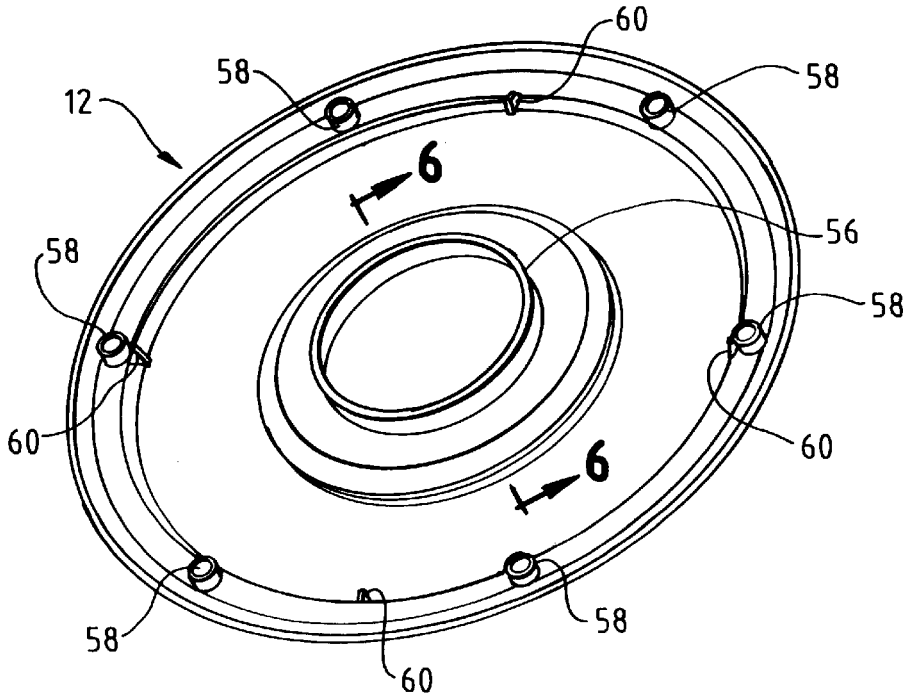
FIG. 4 is a top perspective view of the bottom portion of the paint tray assembly.

FIG. 4 illustrates a top perspective view of the bottom portion 12 of the paint tray assembly 10. The bottom portion 12 includes a center neck 56, which is used to mate with the top portion 14. The bottom portion 12 further includes cylindrical silos 58 spaced apart and arranged in a circle. The cylindrical silos 58 provide a space for receiving ball bearings, positioned between the bottom portion 12 and the top portion 14. The ball bearings serve to reduce friction between the bottom portion 12 and the top portion 14, as the two portions 12 and 14 rotate with respect to one another.

Figure 7:
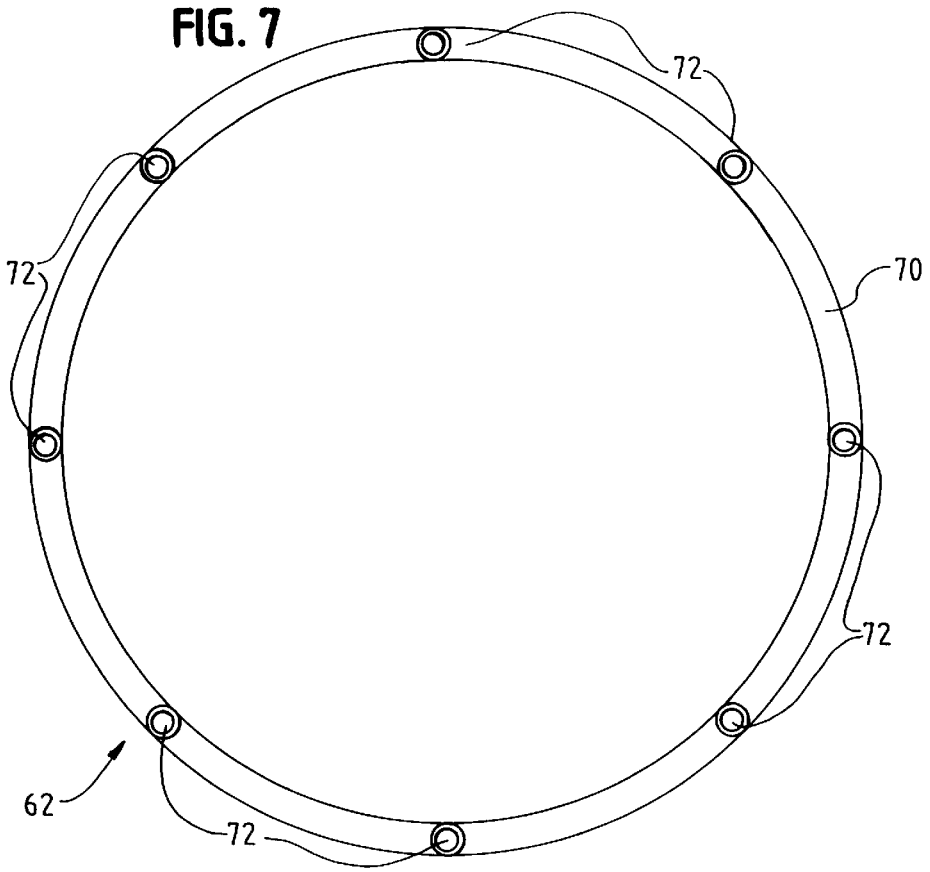
FIG. 7 is a top view of a separate ball bearing rotational device for use in the paint tray assembly shown in FIG. 1.

Alternative to using cylindrical silos 58 for retaining the ball bearings upon which the bottom portion 12 and the top portion 14 rotate with respect to one another, the bottom portion 12 can provide for clips 60, which may be molded as part of the bottom portion 12, for receiving a separate ball bearing rotational device 62, shown in FIG. 7.

Figure 5:
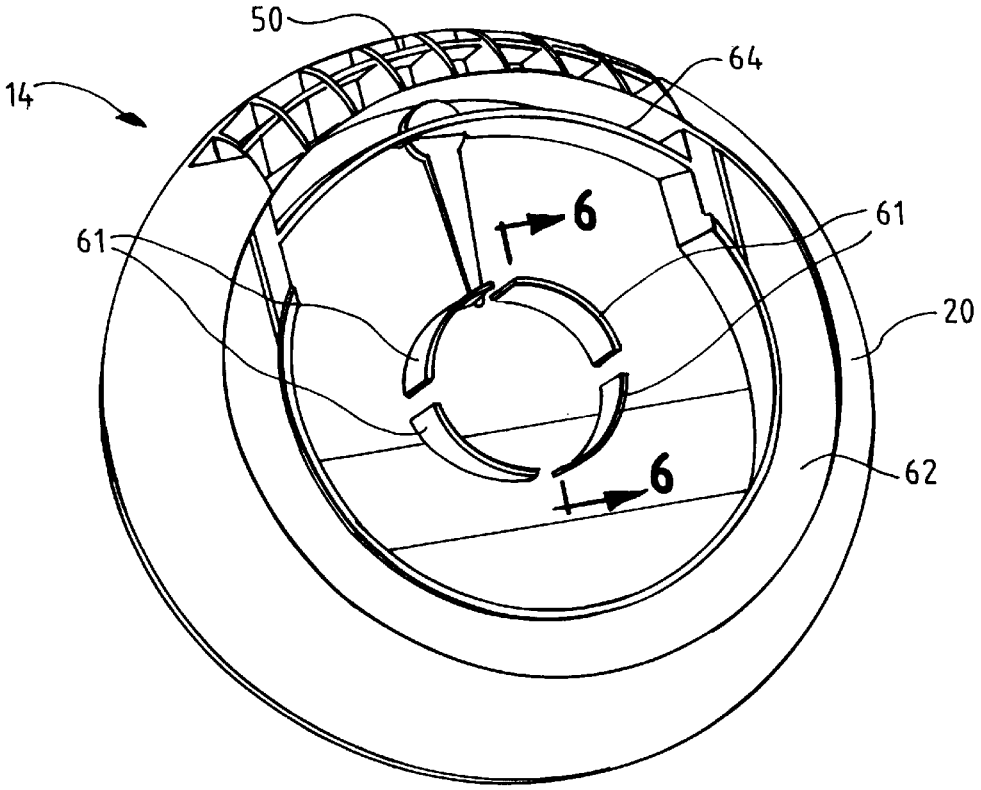
FIG. 5 is a bottom perspective view of the top portion of the paint tray assembly.

FIG. 5 is a bottom perspective view of the top portion 12 of the paint tray assembly 10. The bottom view of the top portion 12 illustrates cantilevered arms 61 arranged in a circle, which mate with the cylindrical neck 56, shown in FIG. 4. Further illustrated is a bearing surface 62, which contacts the ball bearings located between the top portion 14 and the bottom portion 12. Near the back of the paint tray assembly 10, the bearing surface 62 narrows to form a wall 64, upon which the ball bearings contact as the top portion 14 rotates with respect to the bottom portion 12. In the preferred embodiment, the bearing surface 62 narrows to form a wall 64, in order to facilitate the molding of the ramped surface 22.

Figure 6:
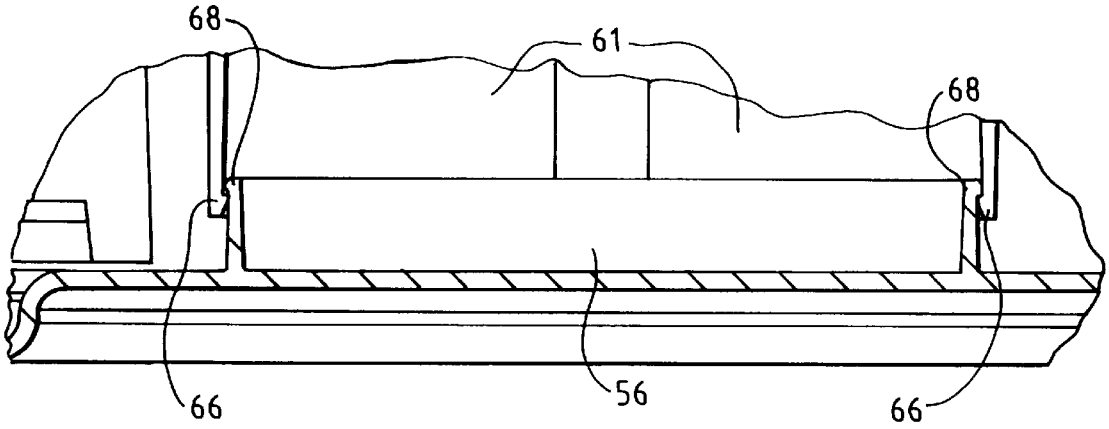
FIG. 6 is a partial sectional view showing the mating of the top portion and the bottom portion of the paint tray assembly shown in FIG. 1.

FIG. 6 is a partial sectional view more clearly showing the cantilevered arms 61 of the top portion 14 mating with the cylindrical neck 56 of the bottom portion 12. As shown in FIG. 6, located at the end of each of the cantilevered arms 61 is a ridge 66, which protrudes inward. Correspondingly at the top of the cylindrical neck 56 is formed a ridge 68, which protrudes outward and forms a ring around the cylindrical neck 56.

When the cantilevered arms 61 are mated with the cylindrical neck 56, the cantilevered arms 61 are initially deflected outward. Once the ridges 66 of the cantilevered arms 61 extend over the ridge 68 of the cylindrical neck 56, the cantilevered arms 61 return back toward their normal position. The ridges 66 of the cantilevered arms 61 are captivated behind the ridge 68 of the cylindrical neck 56, which helps to prevent the bottom portion 12 from separating from the top portion 14, while allowing the two portion 12 and 14 to rotate with respect to one another.

FIG. 7 illustrates a separate ball bearing rotational device 62 for alternatively retaining the ball bearings located between the bottom portion 12 and the top portion 14 upon which the two portions 12 and 14 rotate with respect to one another. The separate ball bearing rotational device 62 is for use in place of the cylindrical silos 58, shown in FIG. 4. One example of a separate ball bearing rotational device 62 includes a ring structure 70 having circular openings 72 for retaining ball bearings, spaced around the ring structure 70. However other similar type rotational devices could similarly be used. The separate ball bearing rotational device could be positioned on the bottom portion 12 via clips 60, shown in FIG. 4, which could be molded as part of the bottom portion 12.

From the foregoing description, it will be apparent that the paint tray assembly 10 of the present invention has a number of advantages, some of which have been described above and others of which are inherent in the invention. Also it will be understood that modifications can be made to the paint tray assembly 10 described above without departing from the teachings of the invention.

I claim:

1. A paint tray assembly for applying a liquid to a roller comprising a bottom portion adapted for resting upon a support surface; and a top portion rotationally coupled to said bottom portion, said top portion including:

a reservoir having a floor, a sidewall extending around said floor for retaining the liquid to be applied to the roller, and a ramped surface starting at or near a section of said sidewall and gradually decreasing in height as said ramped surface extends away from said sidewall down into said reservoir, for allowing the liquid to be spread onto the roller, and excess liquid to flow back into said reservoir; and a contact point for applying a force to said top portion for rotating said top portion with respect to said bottom portion, wherein said bottom portion remains rotationally stationary with respect to the support surface.

2. The paint tray assembly according to claim 1, wherein an external surface of said paint tray assembly is sloped, for forming said paint tray assembly having an external circumference narrower at said bottom portion of said paint tray assembly where said bottom portion rests upon the support surface.

3. The paint tray assembly according to claim 1, wherein a section of said sidewall, opposite said section of said sidewall where said ramped surface starts, forms a hood which extends up and back over said reservoir partially enclosing said reservoir from above.

4. The paint tray assembly according to claim 3, wherein said paint tray assembly includes a handle located opposite said section of said sidewall forming a hood.

5. The paint tray assembly according to claim 4, wherein said handle is molded as part of said sidewall of said reservoir.

6. The paint tray assembly according to claim 1, wnerein said top portion further includes cantilevered arms arranged in a circle and extending downward toward said bottom portion, each cantilevered arm having a ridge, which protrudes in, located at the end of each cantilevered arm, and said bottom portion includes a cylindrical neck extending toward said top portion and having a ridge, which protrudes out, forming a ring around said cylindrical neck, and is adapted for engaging said cantilevered arms for holding said top portion and said bottom portion together, while allowing said top portion and said bottom portion to rotate with respect to one another.

7. The paint tray assembly according to claim 1, further comprising bearings coupled between said top portion and said bottom portion.

8. The paint tray assembly according to claim 7, wherein said bottom portion further includes silos arranged in a circle and extending toward said top portion, for containing said bearings.

9. The paint tray assembly according to claim 8, wherein said top portion further includes a track upon which said top portion contacts the bearings.

10. The paint tray assembly according to claim 7, further including a separate rotational ring device for containing said bearings.

11. The paint tray assembly according to claim 1, wherein said contact point comprises an indentation in said top portion adapted for receiving a part of the roller.

12. The paint tray assembly according to claim 11, wherein said indentation includes a slot forming a channel by which excess liquid can flow back into said reservoir.

13. The paint tray assembly according to claim 1, wherein said paint tray assembly further comprises a notch adapted for hooking a part of the paint roller for pulling said paint tray assembly across the support surface.

14. The paint tray assembly according to claim 1, wherein said top portion further includes a brush retaining wall extending above said floor of said reservoir.

15. The paint tray assembly according to claim 14, wherein said brush retaining wall includes an opening for allowing liquid dripping from the brush to return to the reservoir.

16. The paint tray assembly according to claim 15, wherein said floor of said reservoir is slightly tilted so that the deepest portion of said reservoir is located at the point where said ramped surface meets said floor of said reservoir.

17. A paint tray assembly for applying a liquid to a roller having a bottom side adapted for resting upon a support surface and a top side, said paint tray assembly comprising:

a reservoir having a floor, a sidewall extending around said floor for retaining the liquid to be applied to the roller, and a ramped surface starting at or near a section of said sidewall and gradually decreasing in height as said ramped surface extends away from said sidewall down into said reservoir, for allowing the liquid to be spread onto the roller, and excess liquid to flow back into said reservoir; and an engagement point for hooking and pulling the paint tray assembly across the support surface; and wherein the external surface of said paint tray assembly is sloped for forming said paint tray assembly having an external circumference narrower at said bottom side of said paint tray assembly where said bottom side rests upon the support surface.

18. The paint tray assembly according to claim 17, wherein said engagement point is a notch in said sidewall adapted for hooking a part of the paint roller for pulling said paint tray assembly across the support surface.

* * * * *